US006935582B2

(12) United States Patent
Ruehle et al.

(10) Patent No.: US 6,935,582 B2
(45) Date of Patent: Aug. 30, 2005

(54) FUEL INJECTOR

(75) Inventors: Wolfgang-Manfred Ruehle, Ditzingen (DE); Matthias Boee, Ludwigsburg (DE); Norbert Keim, Loechgau (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/433,727

(22) PCT Filed: Aug. 23, 2002

(86) PCT No.: PCT/DE02/03091

§ 371 (c)(1),
(2), (4) Date: Nov. 5, 2003

(87) PCT Pub. No.: WO03/031808

PCT Pub. Date: Apr. 17, 2003

(65) Prior Publication Data

US 2004/0075000 A1 Apr. 22, 2004

(30) Foreign Application Priority Data

Oct. 4, 2001 (DE) ..... 101 48 824

(51) Int. Cl.[7] ..... B05B 1/30; F02M 51/00; F02M 59/00; F02M 61/00; F02M 63/00

(52) U.S. Cl. ..... 239/585.1; 239/585.5; 239/533.2; 239/533.3

(58) Field of Search ..... 239/585.1, 585.5, 239/533.2, 585.2, 585.3, 585.4, 533.3, 533.9, 533.11; 251/129.16, 129.18, 129.21, 129.22

(56) References Cited

U.S. PATENT DOCUMENTS 4,111,365 A 9/1978 Kimbara

FOREIGN PATENT DOCUMENTS

| | | |
|---|---|---|
| DE | 32 30 843 | 2/1984 |
| DE | 196 26 576 | 1/1998 |
| DE | 196 50 865 | 6/1998 |
| DE | 197 01 879 | 7/1998 |
| DE | 198 26 011 | 12/1998 |
| EP | 0 780 569 | 6/1997 |

*Primary Examiner*—David A. Scherbel
*Assistant Examiner*—Darren Gorman
(74) *Attorney, Agent, or Firm*—Kenyon & Kenyon

(57) ABSTRACT

A fuel injector includes a magnetic coil, which cooperates with an armature which, together with a valve needle acted upon by a restoring spring, forms an axially movable valve part. A valve-closure member which forms a sealing seat together with a valve-seat member, is provided at the valve needle. Furthermore, the fuel injector includes an inner pole and an outer pole which form a magnetic circuit together with the magnetic coil, and a central fuel supply. A sleeve is situated in the central fuel supply of the fuel injector in such a way that a flow route of the fuel through the fuel injector is formed such with respect to length and diameter that the frequency of natural oscillations which are excited by the fuel flowing through the fuel injector, is adjusted to the closing intervals of the fuel injector.

9 Claims, 1 Drawing Sheet

FUEL INJECTOR

FIELD OF THE INVENTION

The present invention relates to a fuel injector.

BACKGROUND INFORMATION

As an example, German Patent Application No. DE 196 26 576 describes an electromagnetically actuable fuel injector in which, for the electromagnetic actuation, an armature cooperates with an electrically energizable magnetic coil, and the armature lift is transmitted to a valve-closure member via a valve needle. The valve-closure member cooperates with a valve-seat surface to form a sealing seat. A plurality of fuel channels is provided in the armature, and the armature is reset by a resetting spring.

A particular disadvantage of the fuel injector described in German Patent Application No. DE 196 26 576 is that, in the part throttle range, the fuel quantity flowing through the fuel injector cannot be metered with sufficient precision when the valve-closure member lifts off from the sealing seat. Especially when the fuel injector is opened rapidly, there are sudden pressure drops in front of the sealing seat, which causes hydraulic compressive oscillations and subsequently considerable dispersions both in the injected fuel quantity and the injection characteristics of all fuel injectors of an internal combustion engine.

SUMMARY

An example fuel injector according to the present invention includes a sleeve which is inserted in the central fuel feed of the fuel injector which modifies the flow route of the fuel flowing through the fuel injector in length and diameter in such a way that the excited natural compressive oscillations of the fuel injector are able to be synchronized with the closing pulses of the fuel injector. Thus, the hydraulic dynamic effect of the oscillations exerted on the armature may be utilized for the closing procedure of the fuel injector, especially in the part throttle range.

It may be advantageous if the inner diameter and the length of the sleeve are in direct proportion to one another.

Furthermore, it may be advantageous if, given specific dimensions of a standard fuel injector, only the length and the diameter of the sleeve have to be appropriately selected for achieving the desired effect.

It may also be advantageous if the sleeve is easy to insert in the fuel supply and can be sealed from the environment of the fuel injector by a seal. A fuel-distributor line may be connected to the sleeve according to the present invention without any design modifications and prior to inserting the sleeve in the central fuel supply.

BRIEF DESCRIPTION OF THE DRAWING

An exemplary embodiment of the present invention is represented in the drawing in simplified form and explained in greater detail in the following description.

DETAILED DESCRIPTION

Figure 1:
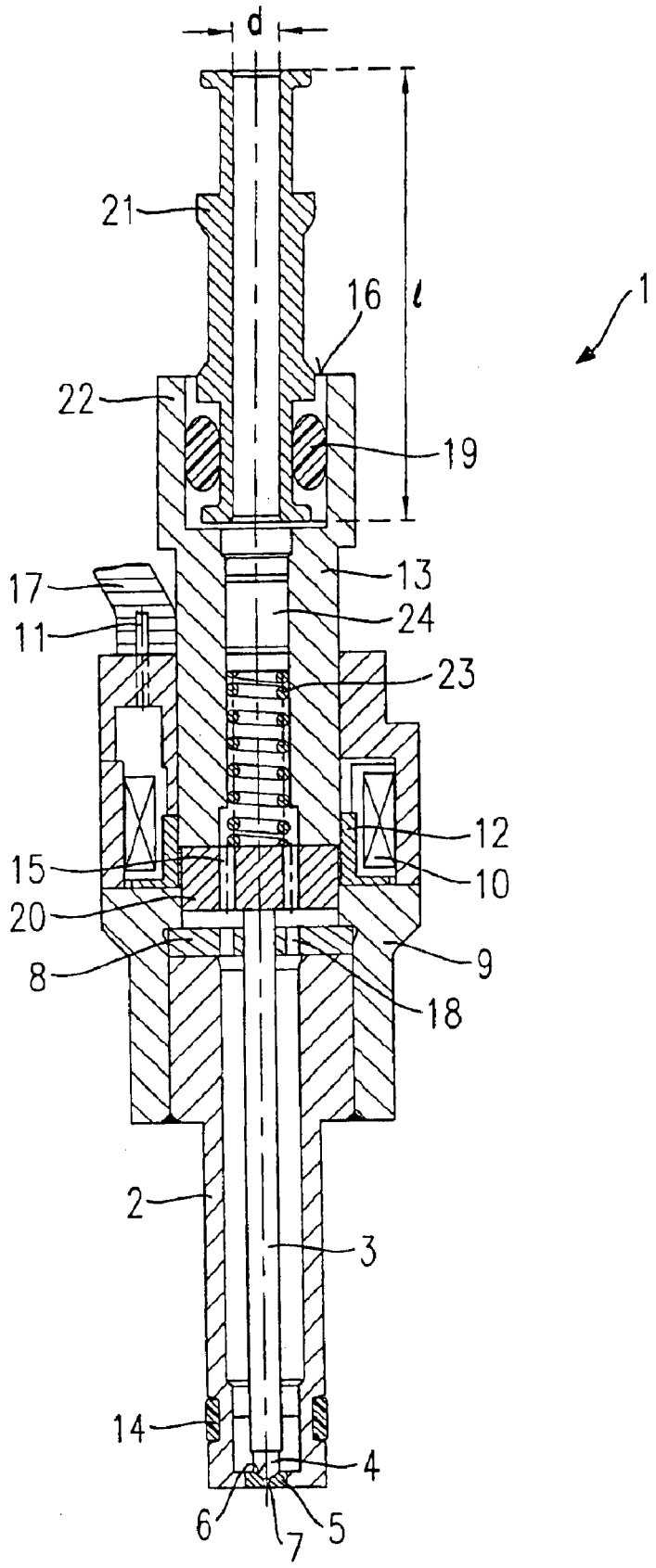
FIG. 1 shows a schematic section through an exemplary embodiment of a fuel injector configured according to the present invention.

In a part-sectional representation, FIG. 1 shows an exemplary embodiment of a fuel injector 1 designed according to the present invention. Fuel injector 1 is configured in the form of a fuel injector for fuel-injection systems of mixture-compressing internal combustion engines having external ignition and is suited for the direct injection of fuel into a combustion chamber (not shown) of an internal combustion engine.

Fuel injector 1 is made up of a tubular nozzle body 2 in which a valve needle 3 is positioned. Valve needle 3 is in operative connection with a valve-closure member 4, which cooperates with a valve-seat surface 6 positioned on a valve-seat member 5 to form a sealing seat. Fuel injector 1 in the exemplary embodiment is an inwardly opening fuel injector 1 which has at least one spray-discharge orifice 7. Nozzle body 2 includes a seal 14 which seals the combustion chamber from a cylinder head (not shown).

Nozzle body 2 is connected to an outer pole 9 of a magnetic coil 10. Magnetic coil 10 is wound on a coil brace 12 and cooperates with an inner pole 13 of magnetic coil 10. Magnetic coil 10 is energized via a line 11 by an electric current which may be supplied via an electrical plug contact 17. Plug contact 17 may be encased by a plastic coating (not shown further).

Valve needle 3 is connected by force locking to an armature 20. Braced on armature 20 is a restoring spring 23 which in the present design of fuel injector 1 is prestressed by a sleeve 24.

The fuel is usually conveyed to fuel injector 1 by a fuel-distributor line via a central fuel supply 16. In the illustrated exemplary embodiment of a fuel injector 1 configured according to the present invention, fuel injector 1 is extended by a sleeve 21 which will be described in greater detail in the following. Sleeve 21 is inserted in a tubular, inflow-side end 22 of fuel injector 1 and sealed by a seal 19. The fuel is conveyed to the sealing seat via bores 15 in armature 20 and fuel channels 18 in a valve-needle guide 8.

In the rest state of fuel injector 1, valve needle 3 is provided with an initial stress by restoring spring 23, in such a way that valve-closure member 4 is sealingly held at valve-seat surface 6, thereby keeping fuel injector 1 closed. A working gap formed between armature 20 and inner pole 13 is closed as is a prestroke gap formed between a flange and a shoulder of valve needle 3.

When magnetic coil 10 is energized by electric line 11 via plug contact 17, a magnetic field is built up which pulls armature 20 to inner pole 13, counter to the force of restoring spring 23. The fuel conveyed via sleeve 21 is able to flow to the sealing seat through bores 15 in armature 20 and fuel channels 18.

If the coil current is switched off, armature 20 falls away from inner pole 13 after sufficient decay of the magnetic field, due to the pressure of restoring spring 23, whereupon valve needle 3, which is in operative connection to armature 20, moves in a direction counter to the lift direction. As a result, valve closure member 4 comes to rest on valve-seat surface 6, and fuel injector 1 is closed.

According to the present invention, fuel injector 1 has a sleeve 21 inserted in central fuel supply 16, by which the compressive oscillations generated during the actuation of fuel injector 1 are able to be selectively used to reduce the dispersion in the metering of minimal quantities. Due to the rapid opening of fuel injector 1, there are sudden pressure drops in front of the sealing seat, which excite compressive oscillations of certain frequencies in fuel injector 1. As a result of the end height of armature 20 which induces a run-time difference between an inflow-side armature-end face and a discharge-side armature-end face, periodically changing pressure ratios occur. The pressure loss which takes place when the fuel flows through bores 15 of armature 20 contributes to this as well. As a result, armature 20 is exposed to high compressive forces which lead to periodically changing closing times of fuel injector 1 and which, therefore, have a direct effect on the metered fuel quantity.

However, by an appropriate design of fuel injector 1, it is possible to use the aforementioned hydraulic pressure fluctuations to improve the metering dynamics of fuel injector 1. Especially in the case of short injection times, the closing procedure of fuel injector 1 may be aided by the periodic compressive forces, thereby allowing an improved metering of minimal quantities in partial-throttle operation. The metering remains unchanged in full-throttle operation.

For this purpose, the individual components of fuel injector 1 directly involved in the excited oscillations are dimensioned and adjusted to each other in such a way that the pressure fluctuations are able to be periodically utilized to intensify the closing force of restoring spring 23. Especially valve-seat member 5 as well as valve needle 3 and sleeve 21 according to the present invention, which is inserted in central fuel supply 16 and sealed from the environment of fuel injector 1 by a seal 19, must be adjusted to each other. A fuel-distributor line (not shown further) may be connected at sleeve 21.

In order to be able to utilize the oscillations, given fixed dimensions of the remaining components of fuel injector 1, sleeve 21, for example, should have a specified length l or a multiple thereof and diameter d of sleeve 21 should also be adjusted if sleeve 21 is extended. In this way, it is possible to excite the fundamental and the associated harmonic oscillations of fuel injector 1 in such a way that the frequency, or the vibration period, of the oscillations is able to be synchronized with the closing pulses of fuel injector 1. Due to the fixed measurements of valve needle 3 and the other relevant components, it is easy to provide a standard fuel injector 1 with sleeve 21 according to the present invention, thereby improving the closing dynamics of fuel injector 1.

The dimensions of sleeve 21 are conditional upon the frequency ranges of the compressive oscillations. In general, a period duration T of the compressive oscillations should be greater than a typical closing time $t_{ab}$ of a fuel injector 1 as it is assumed to be generally known. Ideally, it even holds that $T/2 \geqq t_{ab}$. With typical closing times of $t_{ab} \approx 0.35$ ms, this results in a frequency range which is below 1.4 kHz. In such a situation, for example, a length l of sleeve 21 of approximately 28 mm results and an inner diameter d of sleeve 21 of approximately 2 mm. If length l of sleeve 21 were doubled, for instance to approximately 56 mm, inner diameter d is doubled as well to approximately 4 mm. The ratio of length l of sleeve 21 to its inner diameter d, thus, is constant and, in the case at hand, amounts to approximately l/d=14. This means that sleeve 21, in a simple manner, may equally be adapted to the connection measurements in the region of fuel supply 16 and to the compressive oscillations.

Were one to include the additional restriction that the pressure in front of the sealing seat is less than the system pressure during the entire opening time of fuel injector 1, and not only during the closing procedure, a frequency range of 1 kHz$\geqq$f$\geqq$200 Hz results for the compressive oscillations. This condition may be satisfied by a sleeve 21 which, for instance, has a length l of approximately 28 mm, and an inner diameter d of approximately 1.5 mm. When the length is doubled to 1 approximately 56 mm, inner diameter d will then increase to approximately 3 mm. The ratio of length l of sleeve 21 to its inner diameter d is 18.7 in this case. As a rule, the ratio of axial length l to inner diameter d of the sleeve preferably is in the range of $10 \leqq l/d \leqq 20$.

The present invention is not limited to the exemplary embodiments shown and is also applicable, for instance, to fuel injection 1 for mixture-compressing, self-ignitable internal combustion engines.

What is claimed is:

1. A fuel injector comprising:

an armature;

a magnetic coil which cooperates with the armature;

a restoring spring;

a valve needle acted upon by the restoring spring, the armature and the valve needle together forming an axially movable valve part;

a valve-seat member;

a valve-closure member provided at the valve needle and forming a sealing seat together with the valve-seat member;

an inner pole and an outer pole which form a magnetic circuit together with the magnetic coil;

a central fuel supply; and a sleeve situated in the central fuel supply in such a way that a flow route of fuel through the fuel injector is configured in length and diameter in such a manner that a natural frequency of hydraulic pressure oscillations excited by the fuel flowing through the fuel injector is adjusted to the closing intervals of the fuel injector.

2. The fuel injector as recited in claim 1, wherein the sleeve has an axial length l in one of: i) a range of 25 mm$\leqq$l$\leqq$31 mm, or ii) a multiple thereof.

3. The fuel injector as recited in claim 1, wherein the sleeve has an axial length of one of approximately 28 mm, or a multiple thereof.

4. The fuel injector as recited in claim 2, wherein the sleeve has an inner diameter which is proportional to the axial length l of the sleeve.

5. The fuel injector as recited in claim 4, wherein a ratio of the axial length l to the inner diameter d of the sleeve is in a range of $10 \leqq l/d \leqq 20$.

6. The fuel injector as recited in claim 5, wherein a ratio of the axial length l to the inner diameter d of the sleeve is approximately l/d=14.

7. The fuel injector as recited in claim 5, wherein the ratio of the axial length l to the inner diameter d of the sleeve is approximately l/d=18.7.

8. The fuel injector as recited in claim 1, further comprising: a seal, the sleeve being sealed from an environment of the fuel injector by the seal.

9. The fuel injector as recited in claim 1, wherein the sleeve is configured to a fuel-distributor line.

* * * * *

UNITED STATES PATENT AND TRADEMARK OFFICE

CERTIFICATE OF CORRECTION

PATENT NO. : 6,935,582 B2
APPLICATION NO. : 10/433727
DATED : August 30, 2005
INVENTOR(S) : Ruehle et al.

It is certified that error appears in the above-identified patent and that said Letters Patent is hereby corrected as shown below:

Column 4, line 12, change "fuel injection 1" to --fuel injectors 1--

Signed and Sealed this

Ninth Day of January, 2007

JON W. DUDAS
*Director of the United States Patent and Trademark Office*